United States Patent [19]

Wimmer

[11] 4,394,922

[45] Jul. 26, 1983

[54] RUBBER STOPPER WITH PLASTIC PULL RING

[75] Inventor: Hans Wimmer, Aachen, Fed. Rep. of Germany

[73] Assignee: The West Company, Phoenixville, Pa.

[21] Appl. No.: 288,020

[22] Filed: Jul. 29, 1981

Related U.S. Application Data

[63] Continuation of Ser. No. 126,888, Mar. 3, 1980, abandoned.

[51] Int. Cl.[3] ..... B65D 39/00; B65D 39/16; B65D 41/28

[52] U.S. Cl. ..... 215/300; 215/320; 215/305

[58] Field of Search ..... 215/296, 299, 300, 305, 215/251, 320

[56] References Cited

U.S. PATENT DOCUMENTS

| | | | |
|---|---|---|---|
| 265,007 | 9/1882 | Bennett | 215/299 |
| 1,296,444 | 3/1919 | Webb | 215/299 |
| 3,017,050 | 1/1962 | Barr | 215/305 |
| 3,750,820 | 8/1973 | Labarre | 215/296 |

FOREIGN PATENT DOCUMENTS

| | | | |
|---|---|---|---|
| 2221354 | 10/1974 | France | 215/296 |

*Primary Examiner*—Herbert F. Ross
*Attorney, Agent, or Firm*—Eugene E. Renz, Jr.

[57] ABSTRACT

A stopper assembly for pharmaceutical containers or the like having a pull ring operable between a position flush with the top face of the stopper and an erect position enageable by the finger of the user for removing the stopper from the container. In acccordance with the preferred embodiment, the stopper and pull ring member are separate elements. The stopper which is preferably made of rubber has an annular groove with a locking shoulder to receive an insert ring of the pull ring member of complemetary shape to retain the two in a locked position. A pull ring is connected to a flange of the insert ring by a flexible hinge. The pull ring normally lies in the plane of the insert ring flange flush with the top face of the stopper and may be easily raised to an erect position to receive a finger of the user to enable removal of the stopper from a container by a pulling action.

6 Claims, 7 Drawing Figures

RUBBER STOPPER WITH PLASTIC PULL RING

This applicaton is a continuation of my prior application, Ser. No. 06/126,888 entitled RUBBER STOPPER WITH PLASTIC PULL RING filed Mar. 3, 1980, now abandoned.

BACKGROUND OF THE INVENTION

The present invention relates broadly to closures for containers and more particularly to a locking stopper made of a resilient material such as rubber or other elastomer.

These closures are typically used on containers for pharmaceutical products. Typically the closure or stopper comprises a body portion having a depending plug portion which snugly engages in the mouth of the container and an enlarged radially directed outer flange portion which seats on the axial end face of the bottle defining the discharge opening therein. When applying or removing the stoppers manually from the container (such as a bottle), generally it cannot be avoided that in grasping the parts of the locking stopper directly adjacent to the mouth edge of the bottle, the fingers also contact the edge of the bottle. This contact presents the danger of contaminating the contents of the container such as rinsing solutions, infusion solutions and the like, which must be maintained sterile. Moreover it has been found that these stoppers are difficult to assemble and remove especially when they have been firmly inserted in place.

With the above in mind, it is an object of the present invention to provide a stopper assembly of the above mentioned type which is easy to handle and wherein the finger contact with the stopper parts directly adjacent to the bottle edge in the assembled position can be avoided. This is achieved in accordance with the present invention by providing a stopper assembly including a gripping element or pull ring in the area of the outer lid side or top face of the stopper which can be advantageously grasped by the user so that direct finger contact of the actual stopper is prevented thereby obviating the dangers of contamination of the container contents.

The gripping element is formed by a gripping handle or the like connected with the locking stopper and formed preferably in the form of a gripping ring. The gripping element is adapted to be actuated easily from its initial seated position flush with the top face of the stopper to an operative erect position engageable by a finger of the user to unseat the stopper from the container when desired. The gripping element and the stopper are preferably made in two parts which can be locked together so that the stopper has a connecting part for the gripping element and this has a connecting piece which can be connected with the stopper. This facilitates a production of the assembly in a very simple manner and there is also the advantage that the gripping element and stopper can each be made from different materials which are each adapted to their objectives.

In accordance with the preferred embodiment of the invention, the stopper has an annular groove with an undercut or the like which opens outwardly towards the outer top face thereof within which an annular connecting piece of the gripping element tightly engages in a snap fit or the like. Besides the fact that this can be simply produced, a comparatively large connecting area is provided as a result of this construction so that undesired separation of the connection is prevented even when a stopper is firmly seated in a bottle opening.

The gripping element comprises an insert ring or the like preferably provided with an abutting flange, the ring having a circumferentially extending barbed projection interacting and engaging with the undercut or the like in the annular groove. This gripping element is also capable of being manufactured and produced rather economically. The abutting flange is directed approximately radially outwardly and forms a support rim for a locking member or the like which can be screwed or crimped over the stopper.

The undercut is preferably provided on the radially inner side of the groove and the wall of the insert ring is tapered at its inserting end to facilitate assembly. The groove defining part determines the shape in this case of the counter connecting piece which is connected with the gripping element. Assembly of the locking stopper in the groove can be simplified by the somewhat tapered form of the inserting end of the insert ring.

A further feature of the present invention is the arrangement wherein the gripping ring is connected with the insert ring preferably by an elastic pivot and is located in the initial position approximately concentrically with the insert ring. In other words, in the initial position the gripping element lies in a plane flush with the top face of the stopper and there is no interfering projection of the gripping element. On the other hand, when it is desired to remove the stopper, the gripping element can be easily raised without problems as a result of the elastic pivoting arrangement and then the fingers of the user may be inserted in the gripping ring.

The insert ring and the abutting flange are preferably made of an inherently stable material such as plastic. The gripping element has a good inherent stability as a result of this construction and also permits the transmission of greater removal forces by the user. Moreover, the holding pressure exerted on the stopper by an additional screw cap or the like used to seat the stopper assembly on the container can be easily transmitted further via the somewhat more inherently stable gripping element. In accordance with the present invention, the gripping ring is disposed within the abutting flange plane in its initial position and is preferably unilaterally connected with this abutting flange by at least one connecting hinge or cross piece. By this arrangement the gripping ring and also the gripping element as a whole does not interferingly project beyond the outline of the stopper. As a result, accidental removal of the stopper from the bottle opening, for example, by snagging and other reasons, is prevented. In large diameter stoppers, the gripping ring may be connected to the abutting flange by several connecting hinges. Specifically two diametrically opposed connecting bridges or cross pieces can be provided so that in this instance two semicircular rings are formed which arch upwards towards each other to allow insertion of a finger in the rings. In this case, a substantially symmetrical removal force is produced upon movement of the stopper in a direction to remove it.

DESCRIPTION OF THE DRAWINGS

These and other objects of the present invention and the various features and details of the operation and construction thereof are hereinafter more fully set forth with reference to the accompanying drawings, wherein.

DESCRIPTION OF THE PREFERRED EMBODIMENTS

Figure 1:
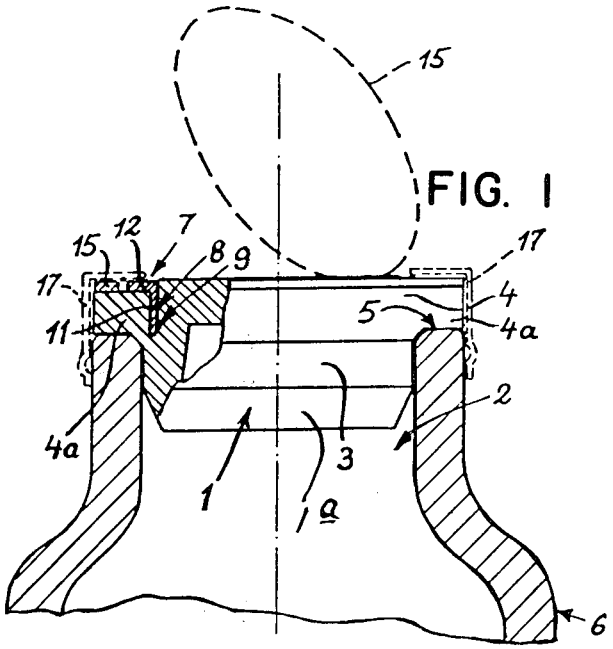
FIG. 1 is a partial transverse sectional view of a stopper assembly in accordance with the present invention inserted in a bottle opening and a screw cap which holds the stopper in place.
Figure 2:
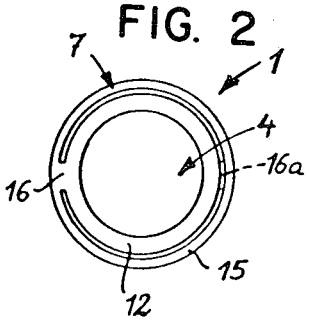
FIG. 2 is a plan view of the stopper with the gripping element in the initial position.
Figure 3:
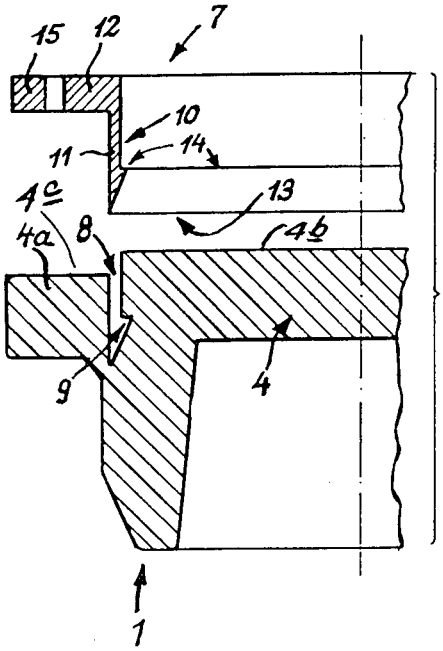
FIG. 3 is an enlarged fragmentary exploded sectional view of the stopper and gripping element.

Referring now to the drawings and particularly to FIG. 1 thereof, there is illustrated a stopper assembly in accordance with the present invention assembled to a container for pharmaceuticals or the like. The stopper assembly comprises a stopper 1 preferably made of rubber or a similar elastomer adapted to seat in a bottle opening 2 and a gripping element for removing the stopper when desired to discharge the contents of the container. The stopper includes a stopper body or plug portion 3 which projects into the container opening and a closing lid 4 having a circumferentially extending radially outwardly directed flange 4*a* which seats on the axial end face 5 defining the discharge opening in the bottle 6. A gripping element generally designated by the numeral 7 is mounted on the stopper. In accordance with the embodiment illustrated in FIGS. 1–4 inclusive, the gripping element is a separate part which can be detachably secured or locked to the stopper. To this end the outer axial end face of the stopper has an annular groove 8 which opens toward the lid side with an undercut 9 in the nature of an arrow-head cross section within which the annular depending counter-connecting piece 10 of the gripping element 7 tightly engages. As illustrated in FIG. 3, the gripping element 7 has an annular insert ring 11 in the form of a circular depending cylindrical projection provided at its upper end with a flange 12 overlying and abutting the flange 4*a* of the stopper. The inner peripheral edge of the insert ring 11 is formed with a barbed projection 14 complementing the cross section of the annular groove 8 and undercut 9 which interacts with the undercut 9 in the stopper so that when the ring is inserted in the groove it firmly locks in place in the stopper. In order to assemble the stopper and the gripping element 7, insert ring 11 of the gripping element is pushed into the annular groove 8 whereby it is slightly elastically deformed in its outer area by the projection 14 until the projection seats and locks behind the undercut 9 of the annular groove 8. The gripping element and stopper are then securely connected with each other. Note that the upper face of the flange 4*a* of the stopper lies in a plane spaced below the top face 4*b* of the stopper body portion to provide an annular pocket 4*c* for the gripping element wherein the top face of the gripping element and stopper lie in a common plane.

The gripping element 7 includes an annular gripping or pull ring 15 connected to the flange 12 of the insert ring 11. The gripping ring 15 is illustrated as being in the initial position illustrated in FIG. 3 within the plane of the abutting flange 12. As illustrated in FIG. 2, the gripping or pull ring 15 is connected with the abutting flange 12 by means of a connecting hinge 16. By this construction the gripping ring 15 can be easily lifted at a point diametrically opposed to the connecting bridge to a raised position illustrated in broken lines in FIG. 1. In this position the user inserts his finger in the ring and with the bottle supported on the other hand simply exerts an axia pull on the stopper assembly. It is noted that the interaction between the terminal edge 14 of the insert ring and stopper groove slot 9 ensures the good locking connection between the two to ensure removal. By this construction, the undesired contact between the operator's hands and the bottle parts directly adjacent to the stopper the stopper edge are avoided. This is essential in maintaining sterility of the container contents.

In order to facilitate insertion of the insert ring 11 into the annular groove 8 of the stopper, the lower edge of the insert ring is tapered as at 13 (FIG. 3). The assembly may further include an overcap or the like indicated at 17 which has a radially inwardly extending upper flange portion which overlies the locking ring and insert flange 12 and which has a skirt which may be threaded or have other means for securing it to the stopper. By this arrangement when it is desired to remove the stopper, the overcap is simply removed by threading it off of the container and then the gripping ring pivoted about its bridge connection 16 in the manner described above.

Figure 4:
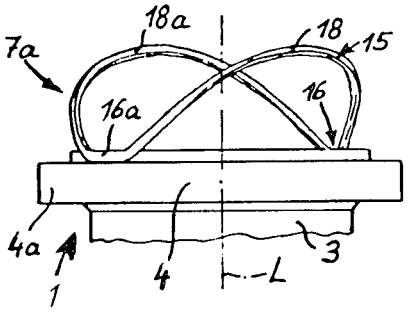
FIG. 4 shows a slightly modified embodiment of stopper assembly with semi-circular gripping rings.

There is illustrated in FIG. 4, a slightly modified embodiment of gripping element in accordance with the present invention. The construction and arrangement of the stopper and gripping element assembly are generally similar to that described above. However, in this instance, the gripping ring 15 is connected to the flange 12 of the insert ring by a pair of diametrically opposed hinges or cross pieces 16, 16*a*. In this manner two generally semicircular gripping rings 18, 18*a* are formed. As illustrated in FIG. 4, these arcuate ring segments, as in the previously described embodiment, normally lie in the plane of the flange 12 which in turn, by reason of the stepped configuration of the stopper, lies flush with the top face of the stopper. Then when it is desired to remove the stopper, the ring portions 18, 18*a* are simply raised by gripping them midway between the pivot or hinge locations 16, 16*a*. The fingers of the user are then inserted under the looped portions to pull the stopper out. This modified version is particularly adapted for large diameter stoppers so that the unobstructed loop area under the ring sections 18, 18*a* is at least large enough to allow a finger to be inserted under them to pull the stopper. Further by this construction of the gripping element 7*a*, the stopper is removed axially in a direction parallel to the central axis L of the container opening 2 of the bottle. This may be advantageous for certain shapes of the locking stopper and/or the bottle mouth.

Figure 5:
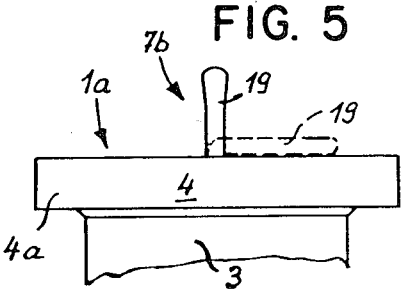
FIG. 5 shows still another modified embodiment off stopper with a gripping handle.

FIG. 5 shows a further modification in accordance with the present invention. In this embodiment, the arcuate semi-circular gripping handle 19 is formed integrally with the top face of the stopper. The handle normally lies flat in the broken line position and may be pivoted to an upright position to pull out the stopper.

The insert ring is preferably made of an inherently stable material such as plastic. A polypropylene having a durometer of approximately 70 has been found to be suitable. In this manner the gripping element 7, 7*a* can be easily inserted in the annular groove of the stopper. Furthermore, by this construction large deformation of the gripping element is prevented when removing the stopper.

Figure 6:
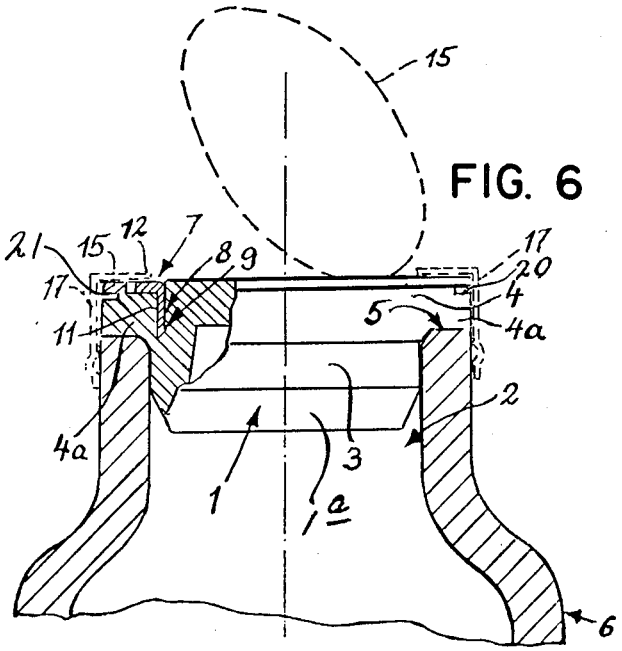
FIGS. 6 and 7 are views similar to FIGS. 1 and 2 showing a further modified form of stopper-pull ring assembly.
Figure 7:
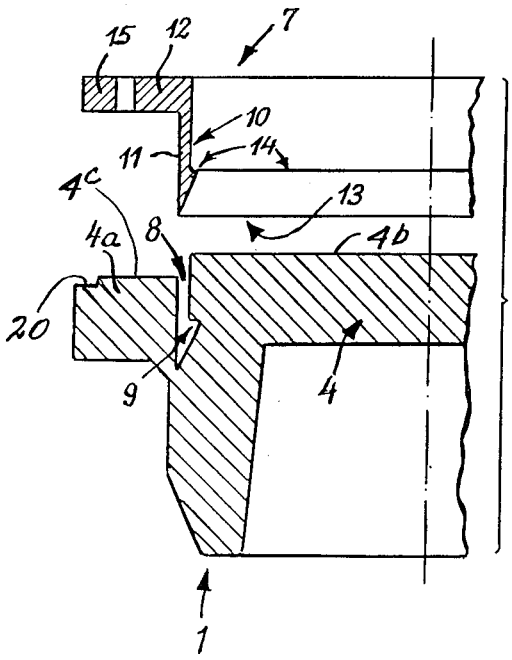

FIGS. 6 and 7 show a further modification. In this instance, the flange 4*a* is stepped as at 20 to provide an annular clearance 21 so that the user can engage under the pull ring should it become adhered slightly to the face of the flange 4*a* of the stopper.

A combination stopper and gripping element according to the present invention has particular application in medicament containers for infusion and rinsing solutions whereby the contents are maintained in a sterile condition by the stopper and are easily discharged simply by removing the stopper in the manner described above. The gripping assembly is characterized by novel features of construction and arrangement which permit opening and reclosing without contacting the stopper body or the bottle edge which may result in contamination of the sterile contents.

While particular embodiments of the present invention have been illustrated and described herein, it is not intended to limit the invention and changes and modifications may be made therein within the scope of the following claims.

What is claimed is:

1. A closure assmbly for containers or the like comprising a stopper made of resilient material including a flange overlying the axial end face surrounding the discharge opening in the container, a gripping member detachably secured to the stopper including a body portion and a ring member pivotally connected to the body portion and adapted to overlie the flange of the stopper, said ring member being hinged to said body portion at diametrically opposed hinge locations and an overcap having a peripheral skirt portion and a top flange overlying at least the ring member and the juncture of the ring member and the body portion.

2. A closure assembly for containers or the like comprising a stopper made of resilient material including a flange overlying the axial end face surrounding the discharge opening in the container, a gripping member detachably secured to the stopper including a body portion and a ring member pivotally connected to the body portion at least at one hinge-point and adapted to overlie the flange of the stopper and an overcap having a peripheral skirt portion and a top flange overlying at least the ring member and the juncture of the ring member and the body portion.

3. A closure assembly as claimed in claim 1 wherein said stopper has an annular groove in its outer axial end face defining a seat within which the body portion of the gripping member engages.

4. A closure assembly as claimed in claim 1 wherein said body portion includes an insert ring in the form of a circular depending cylindrical projection having a barbed projection at its inner terminal edge which complements and engages in an undercut in an annular groove in the stopper so that when the ring is inserted in the groove, it firmly locks in place in the stopper.

5. A closure assembly as claimed in claim 1 wherein the upper face of the flange of the stopper lies in a plane space below the top face of the body portion of the stopper defining a seat for the ring member so that the upper face thereof is generally flush or coplanar with the upper face of the center of the stopper.

6. A closure assembly as claimed in claim 1 wherein the flange of the stopper is stepped to provide an annular clearance at the outer periphery thereof between the stopper and said ring member to facilitate engagement of the ring member by the user when it is desired to actuate it about is hinged location to said body portion.

* * * * *